US012178305B2

(12) United States Patent
Schreiber et al.

(10) Patent No.: US 12,178,305 B2
(45) Date of Patent: Dec. 31, 2024

(54) APPLICATOR FOR APPLYING A PRODUCT TO KERATINOUS MATERIALS

(71) Applicant: L'Oreal, Paris (FR)

(72) Inventors: Camille Schreiber, Clichy (FR); Alain Berhault, Clichy (FR)

(73) Assignee: L'Oreal, Paris (FR)

( * ) Notice: Subject to any disclaimer, the term of this patent is extended or adjusted under 35 U.S.C. 154(b) by 509 days.

(21) Appl. No.: 16/642,198

(22) PCT Filed: Oct. 8, 2018

(86) PCT No.: PCT/EP2018/077346
§ 371 (c)(1),
(2) Date: Feb. 26, 2020

(87) PCT Pub. No.: WO2019/072773
PCT Pub. Date: Apr. 18, 2019

(65) Prior Publication Data

US 2020/0352308 A1 Nov. 12, 2020

(30) Foreign Application Priority Data

Oct. 12, 2017 (FR) ..... 1759548

(51) Int. Cl.
*A45D 40/26* (2006.01)
*A45D 34/04* (2006.01)
*A46B 15/00* (2006.01)

(52) U.S. Cl.
CPC ..... *A45D 40/265* (2013.01); *A45D 34/042* (2013.01); *A46B 15/00* (2013.01); *A46B 2200/1053* (2013.01)

(58) Field of Classification Search
CPC .. A45D 40/265; A45D 34/042; A45D 40/262; A46B 15/00; A46B 2200/1053
(Continued)

(56) References Cited

U.S. PATENT DOCUMENTS 2,221,128 A * 11/1940 Bates ..... A46B 15/00 15/119.2
2,515,094 A * 7/1950 Price ..... A45D 24/16 132/153
(Continued)

FOREIGN PATENT DOCUMENTS

CN 102743007 A * 10/2012 ..... A45D 19/02
CN 106714614 B * 4/2022 ..... A45D 33/00
(Continued)

OTHER PUBLICATIONS

Sanchez M., "CN 106714614 B Abstract Translated" (Year: 2022).*
(Continued)

*Primary Examiner* — Jacqueline T Johanas
*Assistant Examiner* — Holly T. To
(74) *Attorney, Agent, or Firm* — Shumaker, Loop & Kendrick, LLP

(57) ABSTRACT

An applicator for applying a product to keratinous materials, in particular keratinous fibers, notably the eyelashes, the eyebrows and/or the capillary fibers. The applicator including an application member for applying the product on the keratinous materials, in particular the keratinous fibers, notably the eyelashes, the eyebrows and/or the capillary fibers, and a trough at least partially surrounding the application member, when the applicator is viewed in cross section, over an angular extent greater than 60°.

18 Claims, 5 Drawing Sheets

(58) Field of Classification Search
USPC ..... 132/313
See application file for complete search history.

(56) References Cited

U.S. PATENT DOCUMENTS 2,520,605 A * 8/1950 Maynier ..... A45D 40/265 604/289
2,533,106 A * 12/1950 Grover ..... A61C 17/24 15/23
3,181,539 A * 5/1965 Aston ..... A45D 34/042 222/401
3,651,532 A * 3/1972 Wettburg ..... A46B 3/20 15/186
3,763,870 A * 10/1973 Montgomery ..... A45D 40/267 132/218
3,862,639 A * 1/1975 Schefer ..... A45D 40/265 132/112
3,908,676 A * 9/1975 Levine ..... A46B 9/021 15/160
3,921,650 A * 11/1975 Montgomery ..... A45D 40/267 401/128
4,289,153 A * 9/1981 Paccione ..... A46B 11/0055 401/137
4,662,385 A * 5/1987 Schefer ..... A45D 34/04 132/218
4,804,004 A * 2/1989 Taylor ..... A46B 9/021 15/207.2
6,017,162 A * 1/2000 Call ..... A45D 34/041 401/6
6,053,179 A * 4/2000 Lhuisset ..... A45D 40/262 132/142
6,067,997 A * 5/2000 Gueret ..... A46B 9/021 132/218
6,408,857 B1 * 6/2002 Neuner ..... A46B 3/18 132/218
6,539,950 B1 * 4/2003 Gueret ..... A46B 9/021 132/218
6,581,610 B1 * 6/2003 Gueret ..... A45D 40/267 132/218
6,675,814 B2 * 1/2004 Gueret ..... A45D 40/267 15/207.2
6,814,084 B2 * 11/2004 Gueret ..... A46B 9/021 401/122
6,866,046 B2 * 3/2005 Gueret ..... A46B 9/021 132/218
7,156,105 B2 * 1/2007 Gueret ..... A46B 3/18 15/160
7,231,926 B2 * 6/2007 Kim ..... A46B 3/18 132/218
7,322,363 B1 * 1/2008 Dillard ..... A45D 24/26 132/114
D566,402 S * 4/2008 Neuner ..... D4/136
7,497,218 B2 * 3/2009 Gueret ..... A45D 2/48 132/217
7,530,752 B2 * 5/2009 Gueret ..... A46B 9/021 401/122
7,789,094 B2 * 9/2010 Gueret ..... A46B 9/028 132/218
8,042,555 B2 * 10/2011 Neuner ..... A45D 40/265 132/218
8,210,763 B2 * 7/2012 Gueret ..... A45D 40/265 401/129
8,627,831 B2 * 1/2014 Limongi ..... B29C 45/1671 132/218
D781,057 S * 3/2017 Jacob ..... D4/128
9,788,637 B2 * 10/2017 Hauger ..... A45D 40/267
2002/0023657 A1 * 2/2002 Gueret ..... A46B 15/0059 132/218
2003/0029468 A1 * 2/2003 Choi ..... A45D 24/22 132/116
2004/0018037 A1 * 1/2004 Gueret ..... A46D 1/0238 401/122
2004/0161285 A1 * 8/2004 Gueret ..... A45D 34/04 401/122
2004/0221865 A1 * 11/2004 Kim ..... A46B 7/04 132/218
2004/0240926 A1 * 12/2004 Gueret ..... A46D 1/04 15/207.2
2009/0276973 A1 * 11/2009 Bouix ..... A46B 9/021 15/207.2
2010/0021225 A1 * 1/2010 De Laforcade ..... A61M 35/003 401/29
2010/0071715 A1 * 3/2010 Bickford ..... A46B 9/021 132/218
2010/0083979 A1 * 4/2010 Kim ..... A45D 40/264 132/218
2010/0175708 A1 * 7/2010 Kim ..... A46B 9/021 132/218
2010/0294298 A1 * 11/2010 Kim ..... A46B 9/021 132/218
2011/0299913 A1 * 12/2011 Simard ..... A46B 5/0054 401/268
2012/0167910 A1 * 7/2012 Weigel ..... A46B 9/10 132/218
2012/0192892 A1 * 8/2012 Kulik ..... A46B 9/021 132/218
2012/0272992 A1 * 11/2012 Chan ..... A45D 40/265 132/218
2014/0076350 A1 * 3/2014 Aso ..... A46B 3/005 132/218
2015/0320177 A1 * 11/2015 Pires ..... A45D 40/265 401/129
2017/0347776 A1 * 12/2017 Jacob ..... A46B 3/18
2017/0347784 A1 * 12/2017 Jacob ..... A46B 3/18
2018/0027943 A1 * 2/2018 Rosario-Melendez ..... A45D 34/042
2018/0279740 A1 * 10/2018 Kukreja ..... A45D 40/265
2020/0113308 A1 * 4/2020 Park ..... A45D 40/262
2020/0121060 A1 * 4/2020 Chung ..... A45D 34/046
2020/0323327 A1 * 10/2020 Bose ..... A45D 34/043
2020/0329847 A1 * 10/2020 Bianco ..... A45D 34/043
2020/0367631 A1 * 11/2020 Bianco ..... A45D 40/262
2021/0085056 A1 * 3/2021 Kingswell ..... A45D 40/265
2022/0248828 A1 * 8/2022 Poletto ..... A46B 3/18
2023/0210248 A1 * 7/2023 Joo ..... A46B 9/021 132/218

FOREIGN PATENT DOCUMENTS

DE 202016107233 U1 * 2/2017 ..... A45D 40/262
EP 0162722 A2 * 11/1985
EP 1475013 A1 11/2004
EP 2107878 A1 10/2009
EP 2168450 A1 * 3/2010 ..... A45D 40/262
EP 2345342 A1 7/2011
EP 2276370 B1 10/2015
EP 2959798 A1 * 12/2015 ..... A45D 40/267
FR 2662920 A1 * 12/1991
FR 2762494 A1 * 10/1998 ..... A45D 40/267
FR 2889919 A1 3/2007
FR 2897762 A1 8/2007
FR 3070838 A1 * 3/2019
GB 2006619 A * 5/1979 ..... A45D 24/30
JP 2007-050183 A 3/2007
JP 2014-083105 A 5/2014
KR 2013-0003209 U 5/2013
WO 2008/069363 A1 6/2008
WO 2008/091128 A1 7/2008
WO 2009/137259 A2 11/2009
WO WO-2010149366 A1 * 12/2010 ..... A45D 40/265
WO WO-2015083118 A1 * 6/2015 ..... A45D 40/268
WO WO-2016174102 A1 * 11/2016 ..... A45D 40/262
WO WO-2019072773 A1 * 4/2019 ..... A45D 34/042
WO WO-2019072788 A1 * 4/2019 ..... A45D 19/00

OTHER PUBLICATIONS

(56) References Cited

OTHER PUBLICATIONS

International Search Report (ISR) for PCT/EP2018/077346 mailed Nov. 14, 2018 (3 pages).
Written Opinion of the International Searching Authority for PCT/EP2018/077346 mailed Nov. 14, 2018 (5 pages).

* cited by examiner

APPLICATOR FOR APPLYING A PRODUCT TO KERATINOUS MATERIALS

FIELD OF THE INVENTION

The present invention relates to applicators for applying a cosmetic, makeup or care product, notably mascara, to keratinous materials, in particular keratinous fibers, notably the eyelashes, the eyebrows and/or the capillary fibers, and to the packaging and application devices comprising a container containing the product to be applied and the applicator.

BACKGROUND

Many applicators are known comprising a brush which has a core formed by two arms of a metal wire that are twisted together and that grip bristles. The bristles used are generally of the same length and therefore, once the arms are twisted, the brush has an envelope surface in the form of a cylinder of revolution. Such a cylinder of revolution shape has limited effectiveness in terms of loading the eyelashes with product and in terms of separating the eyelashes.

In order to better comb the eyelashes, it has been sought to provide applicators with a comb part that is produced by plastic injection molding. Such applicators can thus comprise an application member comprising, on the one hand, a brush part with a twisted core carrying bristles, and, on the other hand, a comb part comprising spikes on a support. Such applicators may be called "hybrid brushes".

The applications WO 2009/137259 and EP 2 276 370 relate to a cosmetic assembly intended for application, comprising a molded support which carries spikes arranged in several rows.

Applicators are also known which have a single row of spikes, as in JP 2007-50183. In addition, in this application, the brush does not form an application ridge.

In JP 2014-83105, the spikes are arranged at the free end of the applicator. In addition, the brush is cut in order to avoid any deformation of the bristles by the support.

In WO 2008/091128 and EP 2 107 878, and in FR 2 897 762, the brush is cut in order to make space for one or more rows of spikes.

In EP 2 345 342, the brush does not have a twisted core, and instead tufts of bristles are carried by a support with spikes.

In KR 2013-0003209, there are two molded parts, one of which slides with respect to the other.

Moreover, the patents EP 1 475 013, US 2004/0221865 and WO 2008/069363 relate to a mascara applicator comprising a brush part for applying the mascara to the eyelashes and a comb part with spikes for combing the eyelashes. The brush part has one or more angular extents free of bristles, in such a way as to permit placement of the comb part in an angular extent free of bristles.

However, the spikes, combs or comb part may constitute an inconvenience during application on account of the space they take up in front of the eye.

There is a need to further improve applicators for applying a product to the eyelashes and/or eyebrows, in order to improve the performance thereof, and more particularly to promote the creation on the application member of zones that are laden with product, which allow easy application of makeup and rapid and abundant loading of the eyelashes and/or eyebrows in order to give them volume, while retaining a high capacity to separate the eyelashes and/or eyebrows.

The invention aims to meet this objective and, according to one of its aspects, relates to an applicator for applying a product P to keratinous materials, in particular keratinous fibers, notably the eyelashes, the eyebrows and/or the capillary fibers, comprising:

- an application member for applying the product on the keratinous materials, in particular the keratinous fibers, notably the eyelashes, the eyebrows and/or the capillary fibers, and
- a trough at least partially surrounding the application member, when the applicator is viewed in cross section, over an angular extent greater than 60.

Trough

"Trough" is understood as a component in the shape of a small trench forming a furrow of shallow depth in which the application member can be accommodated.

In one embodiment, the application member and the trough are configured in such a way that there is no sliding of the application member with respect to the trough.

The angular extent of the trough, when the applicator is viewed in cross section, may be greater than 90°, preferably greater than 120°, or even greater than 150°. It can be of the order of 180 for example.

The angular extent of the trough, when the applicator is viewed in cross section, may be less than 320°, preferably less than 280° or even less than 240°.

In the above, the angular extent is measured in a plane perpendicular to a longitudinal axis X of the application member.

The trough is not intended to serve for applying the product. The presence of the trough makes it possible to ensure better visibility during the application and better access to the application member. This is because the portion of the application member hidden by the trough does not impede the view of the user, and the space taken up in front of the eyeball is minimized.

In addition, the presence of the trough allows the application member to have an application ridge along the trough, which application ridge can be used for the application and to promote the combing of the eyelashes, eyebrows and/or capillary fibers. These portions along the trough can be relatively well wiped.

The trough can have an outer surface free of any projecting relief. Thus, the outer surface of the trough is clear, and the view of the application member is thereby improved.

"Free of any projecting relief" means that the outer surface of the trough is free of any projecting relief that would be suitable for application of a product, for example a spike, tooth or other outwardly projecting element suitable for engagement with the eyelashes and/or eyebrows and for application of a product.

Nevertheless, it is not a departure from the scope of the present invention if the outer surface of the trough is provided with reliefs, for example microscopic reliefs which are not suitable for the application of a product.

In one embodiment, the outer surface of the trough is smooth.

The trough can have an overall shape, in cross section, of a quarter moon. The trough has, for example, an outer surface convex toward the outside and a concave inner surface. The convex surface is directed outward and the concave surface is directed toward the application member. The outer surface can have the overall shape of a portion of a cylinder.

The application member may be at least partially compressed in the trough. The portion of the application member disposed in the trough can be compressed by the latter, and the rest of the application member can extend freely to the outside. Such local crushing makes it possible to increase the density of the application member at the edge of the trough and to decrease the product charge in this portion, whilst the product change is increased in the portion of the application member opposite the trough, where the density of the latter is less.

The portion of the application member opposite the trough may permit application of the product, whilst the one or more portions of the application member that are near the trough, that is to say the longitudinal edges thereof, may make it possible to promote the combing and smoothing of the eyelashes, eyebrows and/or capillary fibers.

The application member may be free of any cut that could prevent a compression thereof under the trough. The absence of a cut may make it possible to avoid the need for indexing the application member with respect to the trough, during the assembly of the applicator.

In one embodiment, the application member has a symmetry of revolution.

The trough may extend over most of the length $L_1$ of the application member, when the applicator is viewed from the side. The trough may extend over at least 50% of the length $L_3$ of the application member, even over a length $L_2$ of at least 60% of $L_1$, even at least 70%, preferably at least 80%, or even at least 90% of $L_1$. In one embodiment, $L_2$ is equal to $L_1$. In a further variant, $L_2$ may be greater than $L_1$, for example equal to at least 110% of $L_1$, preferably at least 120% of $L_1$ The trough can have two longitudinal edges, which are in contact with the application member.

At least one longitudinal edge of the trough, or both longitudinal edges, can be smooth or serrated. In one embodiment, the longitudinal edges of the trough are smooth and the application member is a brush. In another embodiment, the longitudinal edges of the trough are serrated and the application member comprises a block of porous material, preferably a block of cellular material such as a foam, as will be explained in more detail in the description below.

At least one longitudinal edge of the trough can be rectilinear. In a variant, at least one longitudinal edge of the trough can be non-rectilinear, or the two longitudinal edges of the trough can be non-rectilinear. At least one longitudinal edge of the trough can be curved, notably concave or convex, or undulating, in which case it is therefore alternately concave then convex. In an alternative embodiment, the two longitudinal edges of the trough are rectilinear. In a variant, the two longitudinal edges can both be curved, notably concave or convex, or undulating, in which case they are therefore alternately concave then convex. In an alternative embodiment, one of the longitudinal edges is rectilinear and the other is curved, concave or convex.

The trough may be solid, which is to say that it is free of orifices or through-holes. In a variant, the trough may be openworked.

The longitudinal edges of the trough can place pressure on the application member. It is possible in particular to obtain local crushing of the application member along the longitudinal edges of the trough. In one embodiment, in the case where the application member has a brush, the bristles of the brush can be crushed inside the trough and compressed along the longitudinal edges. In the case where the application member comprises a block of porous material, preferably a block of cellular material such as a foam, as will be explained in more detail in the description below, it can be crushed locally along the longitudinal edges and inside the trough. The longitudinal edges of the trough promote the formation, on the application member, of an application ridge which can be used for the application and to promote the combing of the eyelashes, eyebrows and/or capillary fibers.

The trough may comprise at least one end ring configured to allow it to be fixed to the rest of the applicator. For example, the trough can be fixed to the core of the brush, if appropriate. In a variant, the trough may be fixed, for example, to a stem of the applicator, if appropriate.

In an alternative embodiment, the trough is fixed by its proximal and distal ends to the rest of the applicator.

The trough may have a seat at its distal end, said seat being configured to receive the distal end of the application member, notably the core of a brush.

The trough may have a snap-fastening tab at its proximal end in order to allow it to be snap-fastened onto the rest of the applicator, notably onto a stem of the applicator or onto the application member, notably onto the core of a brush.

In one embodiment, the trough has snap-fastening tabs for fixing the application member, notably a proximal end of the application member, for example of the brush.

In another alternative embodiment, the trough is formed in one piece with a stem of the applicator.

In this case, the trough may likewise have snap-fastening tabs for fixing the application member, notably a proximal end of the application member, for example of the brush.

The stem may be provided with other snap-fastening tabs at its proximal end for joining it to a cap.

The trough is preferably made of a thermoplastic material, in particular an elastomeric thermoplastic material.

Brush

The application member can comprise a brush, notably a brush comprising a core extending along a longitudinal axis X and bristles held by the core in a portion of the core carrying the bristles. The presence of the trough makes it possible to force the orientation of certain bristles toward the outside and thus to simulate the presence of bristles that are longer than their real length, by virtue of their forced orientation. This therefore permits the formation of at least one application ridge along the trough.

The brush may be fixed, notably at its proximal end, to the trough by snap-fastening tabs provided for this purpose on the trough.

In the case where the trough is formed in one piece with a stem of the applicator, it will be appreciated that the stem comprises these snap-fastening tabs for fixing the brush. The stem can thus comprise a slit provided for this purpose on the stem for fixing the brush, which is done by insertion of the proximal end of the brush into this slit and by plastic deformation of the snap-fastening tabs that are provided for this purpose. The strength of the brush can thus be reinforced. The longitudinal axis X can be a central axis, or even an axis of symmetry for the brush, notably when the brush has a circular cross section or a cross section in the overall shape of a regular polygon. The longitudinal axis may be rectilinear or curved and may be contained in a plane, which may be a plane of symmetry for some or even for all of the cross sections of the brush. Preferably, the longitudinal axis is rectilinear. In a variant, it is curved. In the context of this variant, the trough can likewise be curved, notably by having the same radius of curvature as the brush.

In one embodiment, most of the bristles of the brush can have the same length, or all of the bristles of the brush have the same length.

In one embodiment, all the bristles of the brush are identical. In a variant, the bristles can differ in terms of their pliability. For example, when the applicator is seen from the side, the end bristles can be more rigid, in order to allow finishing touches to be made to the makeup, whilst the bristles situated at the center can be more pliable, thus promoting the loading of product.

The bristles of the brush may have free ends defining an envelope surface S, the envelope surface having a shape chosen from the following list: cylindrical, a diabolo shape, peanut shape, kidney shape, rugby ball shape, truncated cone shape, this list not being limiting.

The shape of the envelope surface of the brush can be chosen according to the shape of the longitudinal edges of the trough. An apparent width of the application member can be variable as one moves along the longitudinal axis X. "Apparent width" signifies the width of the application member measured between the longitudinal edges of the trough. Thus, along the longitudinal axis X of the application member, a central portion is obtained which may make it possible to promote the loading of product, and end portions along the longitudinal axis X are obtained which may make it possible to promote makeup application at the corners of the eye.

For example, in the case where the brush is cylindrical, at least one of the longitudinal edges of the trough can be curved, for example concave or convex. In an alternative embodiment, at least one of the longitudinal edges of the trough can be rectilinear, the brush then comprising an envelope surface of non-cylindrical shape, for example a diabolo shape, peanut shape, kidney shape, rugby ball shape, truncated cone shape or other shape.

In the case where at least one of the longitudinal edges of the trough is curved and the brush has an envelope surface of non-cylindrical shape, for example a diabolo shape, peanut shape, rugby ball shape, kidney shape or other shape, the pliability is the same everywhere on the application member, and makeup is applied more uniformly.

The envelope surface of the brush can be free of any furrow or cut in the bristles of the brush, in particular any cut that could prevent compression of the brush inside the trough. To put it another way, in the region of the trough, the brush has bristles that can be crushed by the trough.

The brush can have between 100 and 300 bristles, preferably between 150 and 250 bristles, for example approximately 200 bristles. Thus, the brush has a relatively small number of bristles, which makes it possible to promote the crushing of the bristles in the trough. The bristles of the brush can in part be crushed between the core and the trough. In particular, the bristles of the brush that are disposed in the trough can be crushed inside the latter.

The core of the brush can be composed of a wire folded in a U-shape and twisted in order to from turns, the core having between 10 and 30 turns, preferably between 15 and 25 turns, for example approximately 17 turns.

When the core is twisted, the number of bristles per turn may thus be greater than 5, better still between 10 and 30 bristles per turn, for example around 12 bristles per turn of the core. The "number of bristles per turn" denotes the number of bristle ends counted for a rotation of 180° about the longitudinal axis of the core.

The core may be twisted to the left or to the right. The bristles may extend from the core in two helical layers. The number of turns corresponds to the total number of revolutions of the two layers about the core. The bristles may be made of a natural or synthetic material, for example chosen from PP, PA, PET, PS, PE, PBT or PVC. The bristles may have a magnetic filler or one for improving sliding, for example graphite, PTFE or molybdenum disulfide.

Porous Material

The application member may comprise a block of porous material. In this case, the application member may be without a core. In a variant, the porous material can be fixed to a core. When the applicator is viewed in cross section, the central portion of the porous material can serve in particular to apply product on the eyelashes, eyebrows and/or capillary fibers, and the lateral portion of the porous material, near the trough, can serve in particular for combing the eyelashes, eyebrows and/or capillary fibers.

The porous material can advantageously be a cellular material, such as a foam, in particular an open-pore polymer foam which on its outer surface has free strands formed by all or part of cell ridges that have been cut through by the machining of the foam.

The ends formed by the free strands of the block of foam of the applicator according to the invention make it possible to comb, separate and/or gently lengthen the eyelashes, eyebrows and/or capillary fibers.

The length of the free strands is between approximately 0.1 mm and 4 mm, preferably between 0.5 mm and 2 mm.

It should be noted that, for the one same applicator, the length of the free strands will generally not be constant, because of the fact that they are obtained by the machining of the foam. Some strands will be short, for example with a length equal to approximately 0.1 mm, whereas other strands will be longer, up to a length equal to the length of a cell ridge of the foam, for example 4 mm. Thus, the mean length of the free strands may be comprised between 0.5 mm and 2 mm.

The foam is, for example, machined by a punch, by a laser, by milling and/or by water jet. Machining by milling is particularly advantageous in the context of the present invention, because such a machining method allows an applicator with an envelope surface of complex shape to be produced easily.

The machining of the foam makes it possible to create on the exterior surface of the foam the free strands which will comb the eyelashes, eyebrows and/or capillary fibres. The cells of the foam themselves will make it possible to constitute reserves of product in the immediate vicinity of the combing strands.

The foam is advantageously selected from cross-linked polymer foams. The cross-linking allows the circulation of fluids through the foam, forming open porosity.

The foam is selected for example from cross-linked thermoplastic foams, notably cross-linked polyurethane, cross-linked polyester, cross-linked polyether or cross-linked polyethylene.

A polymer foam in general is to be understood as meaning a cellular material, or material with pockets, made from a polymer and made up of a three-dimensional structure formed by a solid skeleton comprising solid walls and/or solid ridges, surrounding pockets or cells with spatially random orientations.

In a polymer foam, the porosity, which is all of the voids created by the pores, or cells or pockets, exceeds 70% of the total volume of the foam.

What is meant by an "open porosity polymer foam" is the fact that the cells of this material are open to the adjacent cells and to the outside. In this case, it is only the ridges surrounding the cells that form the solid skeleton of the foam. There are no solid walls. The shape of the cells may be spherical or polyhedral.

The number of cells per unit length, more commonly referred to as the PPI (Pores Per Inch), characterizes the polymer foam. It corresponds to the number of pores, or cells or pockets, intercepted in a length of 1 inch (2.54 cm).

The foam used in one embodiment of the applicator according to the invention advantageously has a number of cells per unit length (PPI) of between 10 and 80 PPI.

This foam preferably has a number or cells per unit length of between 20 and 50 PPI, better still equal to about 30 PPI.

In order to measure the number of cells per unit length as a PPI value, it is possible, as visible in FIG. 8, to use a ruler to visually measure the number of cells per unit length, 10 PPI thus corresponds to 10 cells per inch, namely to 10 cells per 2.54 cm. FIG. 14 illustrates six foams placed one after another, along the ruler, exhibiting different PPI values of 8, 10, 15, 20, 25 and 30 PPI respectively, with the PPI value increasing down the figure.

Moreover, the foam used in one embodiment of the applicator according to the invention advantageously has a density of between 15 kg/m$^3$ and 60 kg/m$^3$.

This foam preferably has a density of between 20 kg/m$^3$ and 40 kg/m$^3$, better still equal to about 30 kg/n.

Such ranges of number of foam cells per unit length (PPI) and/or density parameters are particularly advantageous in the context of use of the applicator according to the invention for applying a cosmetic product such as a mascara composition or a coloring product and/or a care product for capillary fibres.

A mascara composition conventionally has a viscosity greater than 5 Pa·s, notably comprised between 5 Pa·s and 50 Pa·s, at 25° C., in particular measured with the aid of a Rheomat RM100® machine.

Such a mascara composition conventionally comprises a solids content, generally in an amount greater than or equal to 35% by weight relative to the total weight of the composition, a pulverulent colorant, in particular one or more pigments, notably one or more metal oxides, for example one or more iron oxides, and advantageously a film-forming polymer. A mascara composition may also conventionally comprise one or more waxes, in a total amount of in particular between 5 and 40% by weight relative to the total weight of the composition.

Thus, such ranges of number of foam cells per unit length (PPI) and/or density make it possible to obtain an applicator that demonstrates a good compromise between its abilities to retain and to release a cosmetic product having a viscosity comprised between 5 Pa·s and 50 Pa·s, notably comprised between 9 Pa·s and 25 Pa·s.

The product retention capacities of an applicator according to the invention in particular make it possible to prevent the cosmetic product held within the foam of the applicator from flowing under gravity through this applicator, thus improving the cleanliness and autonomy of such an applicator. The retention of the cosmetic product within the foam of the applicator is in particular achieved by surface tension of the product held inside the cells present in the foam.

The product-release capacities of an applicator according to the invention in particular make it possible for the product received within the foam of the applicator to be loaded onto the eyelashes/eyebrows and/or the capillary fibres when these are brought into contact with the applicator. The release of the cosmetic product held within the foam of the applicator is achieved in particular by bringing the eyelashes, eyebrows and/or capillary fibres into contact with the cells of the foam, this contact breaking the surface tension that there is between the product and the cells of the foam, the product then being applied on the eyelashes, eyebrows and/or capillary fibres.

By way of example, use may be made of a black-colored polyester polyurethane foam with a density (in accordance with standard ISO 1855) of 29 kg/m3 (+ or −3 kg/m3). By way of example, the PPI value of such a material may be 20 PPI. In this case, the load-bearing capacity (in accordance with standard ISO 3386/1) is 3.7 kPa (+ or −1), the elongation at break (in accordance with standard ISO 1798) is greater than 120% and the tensile strength (in accordance with standard ISO 1798) is greater than 80 kPa. The PPI value may be 30 PPI. In this case, the load-bearing capacity (in accordance with standard ISO 3386/1) is 3.7 kPa (+ or −1), the elongation at break (in accordance with standard ISO 1798) is greater than 150% and the tensile strength (in accordance with standard ISO 1798) is greater than 95 kPa. The PPI value may even be equal to 45 PPI. In this case, the load-bearing capacity (in accordance with standard ISO 3386/1) is 3.8 kPa (+ or −1), the elongation at break (in accordance with standard ISO 1798) is greater than 180% and the tensile strength (in accordance with standard ISO 1798) is greater than 100 kPa. The PPI value may even be equal to 60 PPI. In this case, the load-bearing capacity (in accordance with standard ISO 3386/1) is 4.2 kPa (+ or −1), the elongation at break (in accordance with standard ISO 1798) is greater than 200% and the tensile strength (in accordance with standard ISO 1798) is greater than 140 kPa. The PPI value may also be 80 PPI. In this case, the load-bearing capacity (in accordance with standard ISO 3386/1) is 4.2 kPa (+ or −1), the elongation at break (in accordance with standard ISO 1798) is greater than 230% and the tensile strength (in accordance with standard ISO 1798) is greater than 170 kPa. Of course, intermediate PPI values are possible.

Applicator

The applicator may have a stem that carries the application member at a first end, it being possible for the stem to be fixed at a second end to a gripping member.

The application member may be fixed to the stem by snap-fastening, adhesive bonding, welding, crimping, pressing, stapling, force-fitting, fitting in a cold state or fitting in a hot state, for example by an end piece of the application member being mounted in a seat in the stem. In a variant, the stem is received in a seat provided in the application member.

The application member may extend along a longitudinal axis which, at at least one point along its length, forms a non-zero angle with the longitudinal axis of the stem to which the application member is fixed. The application member may be angled at its attachment to the stem.

The stem may have a first, rigid portion that is extended on the distal side by a second, more flexible portion, for example made of elastomer, that carries the application member.

The visible length of the application member may be between 18 mm and 35 mm, better still between 22 mm and 30 mm, for example equal to around 27 mm.

Packaging and Application Device

The invention also relates to a packaging and application device comprising:

a container containing a product P to be applied, an applicator according to the invention, as defined above.

The gripping member of the applicator may constitute a cap for closing the container.

The container may be provided with a wiping member for removing the excess product present on the stem and on the application member. This wiping member comprises, for example, a lip made of an elastomer material, defining a wiping orifice which preferably has a circular cross section, the diameter of which corresponds substantially to that of the stem.

The product is preferably a mascara.

Make-Up Method

The invention also relates to a method for making up the eyelashes or eyebrows, in which the application member of the applicator as defined above is used to apply the product to the eyelashes or the eyebrows, by orienting the application member toward the eyelashes or eyebrows and orienting the trough opposite thereto, toward the eyeball.

In one embodiment, a part of the application member near a longitudinal edge of the (rough is preferably used to comb and/or smooth the eyelashes or eyebrows. Thus, the presence of the trough makes it possible to ensure better visibility during the application process, in the sense that the portion of the application member hidden by the trough does not obstruct the user's view. The user has a better view of the portion of the application member which serves for the application process and which comes directly into contact with the eyelashes or eyebrows. The user can therefore feel more reassured.

Assembly Method

According to another of its aspects, the invention relates to a method for assembling an applicator as defined above, in which method the application member is inserted into the trough.

The insertion can be carried out in a radial direction. Thus, a radial compression of the application member is obtained, notably of the bristles or the porous material thereof, which can promote the formation of an application ridge and the combing, in particular along the longitudinal edges of the trough.

In a variant, the distal end of the application member can first of all be inserted into the trough before inserting the proximal end of the application member into the trough.

In a subsequent step, the assembled application member can be fixed to a stem of the applicator. Thus, the bristles of the application member are, if appropriate, crushed flat in the trough. The bristles of the application member may not be compressed with an orientation that would result from longitudinal sliding of the application member with respect to the trough.

In an alternative embodiment, the applicator can comprise a trough which is crimped beforehand in a stem of the applicator or made in one piece with the latter, prior to the insertion of the application member into the trough.

In another alternative embodiment, the applicator can comprise a brush with a twisted core which is crimped beforehand in a stem of the applicator, prior to the insertion of the trough into the application member.

Preferably, in the invention, there is no sliding of the application member with respect to the trough. It is thus possible to avoid any wedging of a bristle in the trough.

BRIEF DESCRIPTION OF THE DRAWINGS

The invention may be understood better from reading the following detailed description of nonlimiting exemplary embodiments thereof and from studying the appended drawing, in which.

DETAILED DESCRIPTION

In the rest of the description, identical elements or elements having identical functions bear the same reference sign. Their description is not repeated for each of the figures, only the main differences between the embodiments being mentioned.

Figure 1:
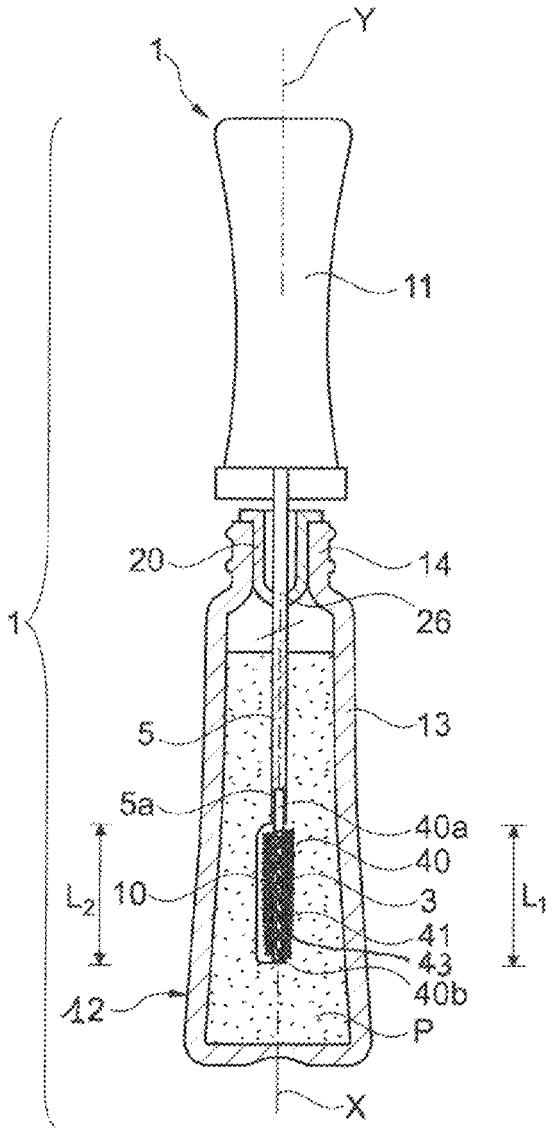
FIG. 1 shows an example of a packaging and application device according to the invention, in schematic and partial longitudinal section.

The packaging and application device 1 shown in FIG. 1 comprises a container 12, which contains a product P to be applied to the eyelashes or the eyebrows C, and an applicator 2 which, in the example in question, can be fixed removably to the container 12. The product P comprises, for example, one or more pigments, notably an iron oxide. It is for example a mascara.

The applicator 2 comprises a stem 5, of longitudinal axis Y, provided at a distal end 5*a* with an application member 3 and a trough 10 according to the invention and, at the other end, with a gripping member 11, which likewise forms a cap for closing the container 12 in a sealed manner. As can be seen notably in FIG. 1, said container 12 has a body 13 provided at the top with a threaded neck 14 onto which the gripping member 11 can be screwed in order to close the container 12 in a sealed manner. In a variant, the applicator may be fixed to the container in some other way.

The neck 14 may accommodate, as illustrated, a wiping member 20 which, for example, is inserted into the neck 14. This wiping member 20 comprises a lip 26 that defines a wiping orifice having a diameter adapted to that of the stem 5.

In the example described, the application member 3 is fixed, in a conventional manner, in a seat provided at the distal end Sa of the stem 5, which is advantageously made of a thermoplastic material.

Figure 2A:
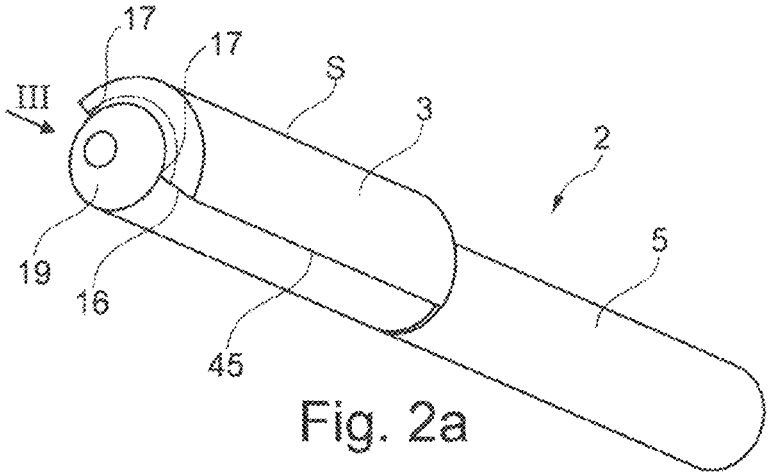
FIGS. 2*a* and 2*b* are schematic perspective views of an example of an application member according to the invention.
Figure 2B:
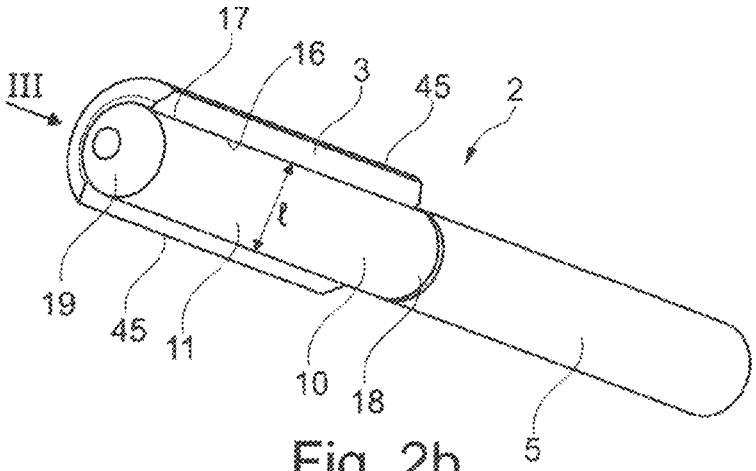
Figure 3:
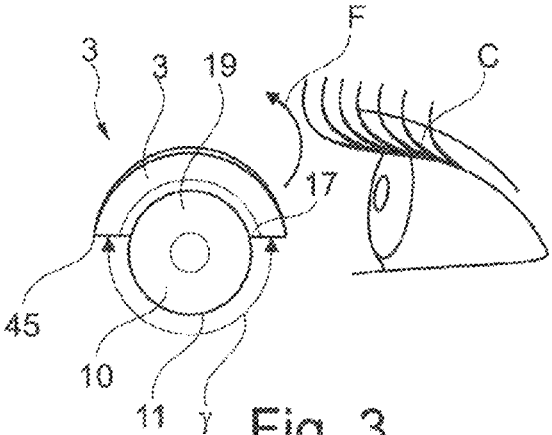
FIG. 3 is a view thereof along the arrow III.
Figure 4A:
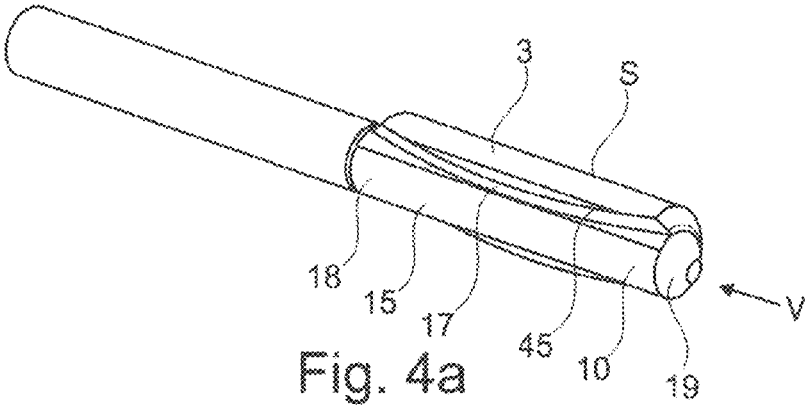
FIGS. 4*a* and 4*b* are schematic perspective views of a variant embodiment.
Figure 4B:
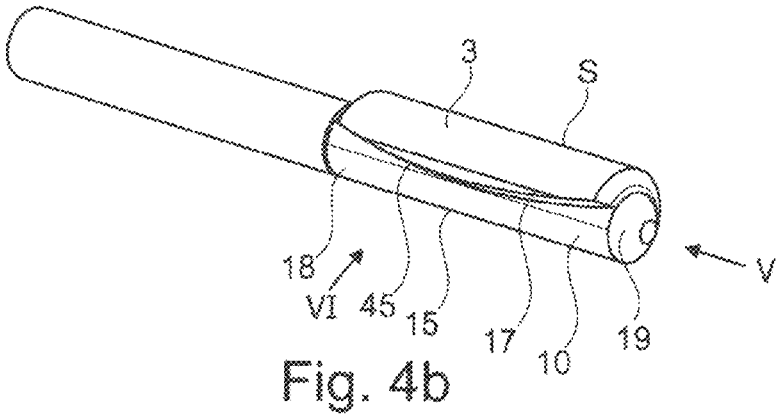
Figure 5:
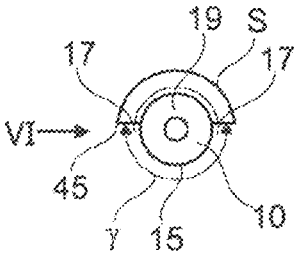
FIG. 5 is a view thereof along the arrow V.
Figure 6:
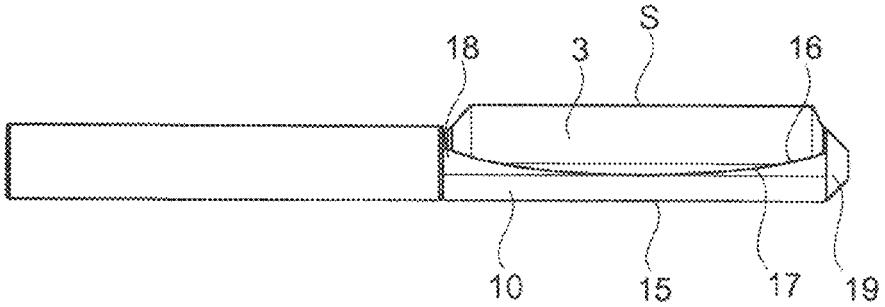
FIG. 6 is a view thereof along the arrow VI.
Figure 7:
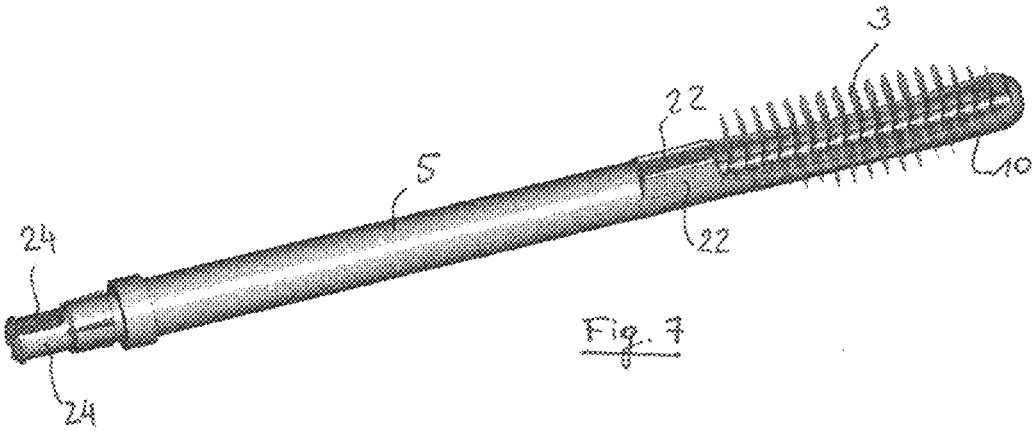
FIG. 7 is a schematic perspective view of a variant embodiment.
Figure 8A:
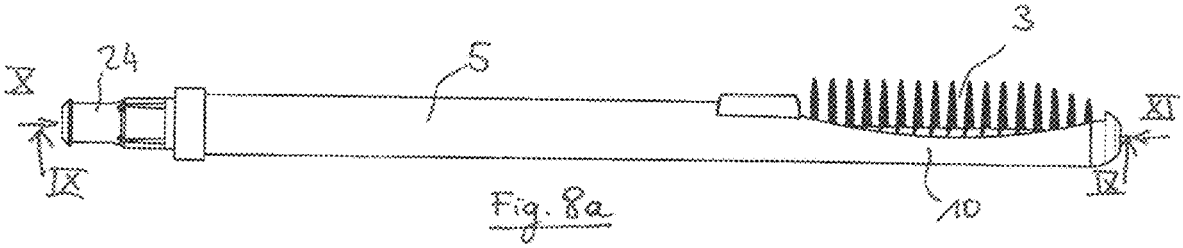
FIGS. 8*a* and 8*b* are views, similar to FIG. 6, of this variant embodiment in FIG. 7.
Figure 8B:
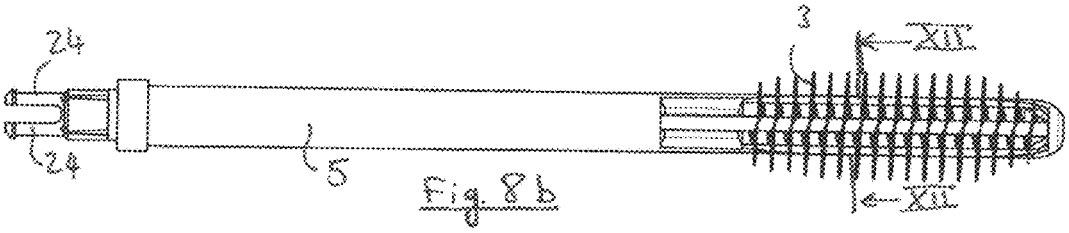
Figure 9:
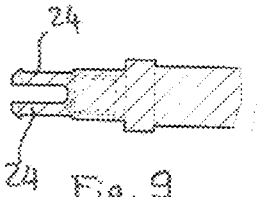
FIG. 9 is a sectional view on IX-IX.
Figure 10:
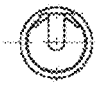
FIG. 10, FIG. 11, and FIG. 12 are views thereof along the arrows X, XI, XII, respectively.
Figure 11:
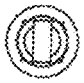
Figure 12:
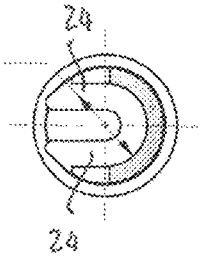

The applicator 2 is shown in more detail in FIGS. 2*a*, 2*b* and 3. It has, on the one hand, the application member 3, which in this example is a brush with a core 40 extending along the longitudinal axis X and bristles 41 held by the core, the bristles 41 having free ends defining an envelope surface S, and, on the other hand, the trough 10 engaged on the brush.

The trough 10 surrounds the application member, when the applicator is viewed in cross section, over an angular extent y of the order of 180°.

The trough is not intended to serve for applying the product. It has an outer surface which is smooth, being free of any relief.

It has the general shape of a portion of a cylinder, with an outer surface 15 convex to the outside and a concave inner surface 16. The convex surface is directed outward and the concave surface is directed toward the application member 3.

The trough has two longitudinal edges 17, which are in contact with the application member 3. In the example described, the two the two longitudinal edges 17 of the trough are rectilinear and parallel to each other and to the longitudinal core of the brush.

The longitudinal edges 17 of the trough place pressure on the application member, in such a way that there is local crushing of the application member along these longitudinal edges 17.

In the example described, the application member 3 is a brush comprising a twisted metal core 40 with a portion 43 carrying bristles 41. The core is fixed at a proximal end 40*a* in the corresponding seat of the stem 5 via a portion without bristles, which portion can have a length of the order of 8 mm. The portion 43 of the core bearing the bristles has a distal end 40*b*.

The core 40 is formed conventionally by two arms of a metal wire folded in a U-shape, the bristles 41 being held between the turns of the core 40 thus twisted. The diameter of the metal wire is, for example, between 0.1 and 1 mm. The diameter of the bristles is, for example, between 0.06 and 0.35 mm.

The free ends of the bristles 41 define an envelope surface S of the brush, which has a symmetry of revolution in the example described.

In the example described, the envelope surface S is free of any furrow or cutting in the bristles of the brush, notably under the trough 10.

The bristles 41 extend on the portion 43 of the core having a length $L_1$ of the core of preferably between 25 mm and 35 mm, for example equal to 30 mm.

The trough extends over a length $L_2$ slightly greater than the length $L_1$ of the brush, when the applicator is viewed from the side, being equal to substantially 105% of Lt.

The presence of the trough makes it possible to force the orientation of certain bristles toward the outside and thus to simulate the presence of bristles that are longer than their real length, by virtue of their forced orientation. This therefore enables the formation, on the application member, of an application ridge 45 along the trough, which application ridge 45 can be used for the application and to promote the combing of the eyelashes, eyebrows and/or capillary fibers.

The bristles of the brush are crushed inside the trough and along the longitudinal edges 17. The portion of the application member disposed under the trough is compressed by the latter, and the rest of the application member extends freely to the outside, as illustrated. Such local deformation makes it possible to increase the density of the application member at the edges 17 of the trough and to decrease the product charge in this portion, whilst the product change is increased in the portion of the application member opposite the trough.

The envelope surface S of the brush is free of any furrow or cutting in the bristles, in particular any cutting that could prevent compression thereof under the trough.

The trough is solid, as illustrated, which is to say that it is free of orifices or through-holes, or in a variant it is openworked.

The trough 10 is additionally provided with a snap-fastening tab 18 at its proximal end in order to allow it to be snap-fastened onto the rest of the applicator, notably onto the core of the brush or onto the stem of the applicator.

Finally, the trough has an end portion 19 comprising a seat for receiving the distal end 40*b* of the application member 3.

As regards the manufacture of the applicator, the applicator is assembled in the following way. The distal end 40*b* of the application member is first of all inserted into the trough, more particularly into the seat formed in the end portion 19 of the latter, before the proximal end 40*a* of the application member is inserted into the snap-fastening tab 18 of the trough.

In a subsequent step, the assembled application member can be fixed to a stem of the applicator. Thus, the bristles of the application member are, if appropriate, crushed flat in the trough.

In order to mold the trough 10, use can be made of any thermoplastic material which is or is not relatively rigid, for example SEBS, a silicone, latex, a material having improved slip, butyl, EPDM, a nitrile, a thermoplastic elastomer, a polyester elastomer, a polyamide elastomer, a polyethylene elastomer or a vinyl elastomer, a polyolefin such as PE or PP, PVC, EVA, PS, SEBS, SIS, PET, POM, PU, SAM, PA or PMMA. It is also possible to use a ceramic, for example based on alumina, a resin, for example of the urea-formaldehyde type, and possibly a material containing graphite as filler. It is possible notably to use the materials known under the trade names Teflon®, Hytrel®, Caritlex®, Alixine®, Santoprene®, Pebax® and Pollobas®, this list not being limiting. In one embodiment, the trough 10 is made of Hytrel®.

In the example just described, the longitudinal edges of the trough 10 are rectilinear. If this is not the case, it does not of course represent a departure from the scope of the present invention.

In the example illustrated in FIGS. 4*a* to 6, the longitudinal edges of the trough are curved, more particularly concave toward the outside. Since the brush is cylindrical, an apparent width l of the application member is variable as one moves along the longitudinal axis. Thus, in the application member, a central portion is obtained which may make it possible to promote the loading of product, and end portions are obtained which may make it possible to promote makeup application at the corners of the eye.

In the example illustrated in FIGS. 7 to 12, the trough 10 is formed in one piece with a stem 5 of the applicator. The trough 10 has snap-fastening tabs 22 for fixing the application member 3, which in this example is a brush.

The stem 5 is additionally provided with other snap-fastening tabs 24 at its proximal end for joining it to a cap (not shown).

The invention is not limited to the examples which have just been described, the features of which can be combined with one another as parts of variants which are not illustrated.

The envelope surface S of the brush may have various general shapes, for example cylindrical, a diabolo shape, peanut shape or rugby ball shape, this list not being limiting.

The brush may comprise any bactericidal agent such as silver salts, copper salts, preservatives and at least one preservative for the product P.

The trough may furthermore comprise particles, for example a filler, in particular a compound which is magnetic, bacteriostatic or absorbs moisture, or else a compound intended to produce roughness on the surface of the trough or to help the eyelashes and/or eyebrows to slide. The trough may be flocked or may undergo any heat treatment or mechanical treatment.

When the application member is other than a brush, this does not of course represent a departure from the scope of the present invention. It may, for example, comprise a block of porous material. In this case, the application member may be without a core. The block of porous material can be crushed locally along the longitudinal edges and inside the trough. In this case for example, the longitudinal edges of the trough may be serrated rather than smooth.

Figure 13:
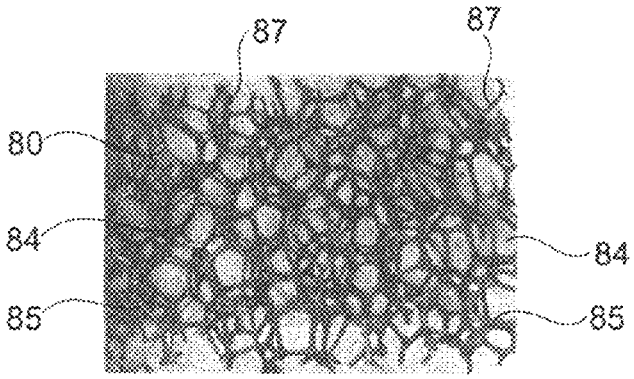
FIG. 13 is an enlarged view of an example of foam that can be used to produce an applicator according to the invention.
Figure 14:
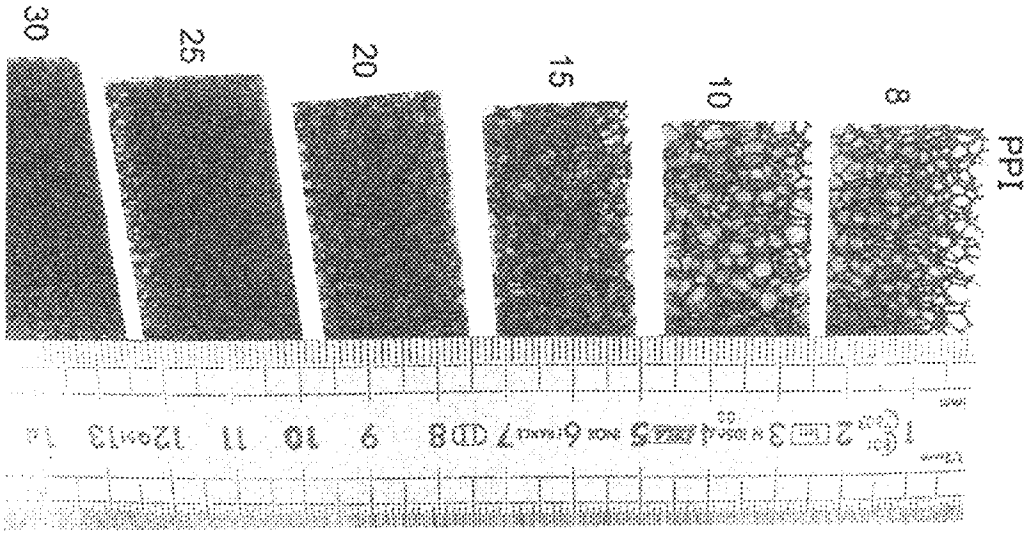
FIG. 14 is a schematic view illustrating several blocks of foam with different PPI values and the method for measuring these values.

In the example illustrated in FIG. 13, such a block of porous material is a cellular material such as a foam, in particular an open-pore polymer foam which on its outer surface has free strands 87 formed by all or part of the cells ridges that have been cut through by the machining of the foam.

As can be seen from FIG. 13, which is an enlarged view of an example of a foam 80 that can be used for producing the application member 3, the foam 80 is a cross-linked open-pore polymer foam, that is to say forming cells 84 that constitute reserves of products delimited from one another only by ridges 85. The free strands 87 are formed by ridges 85 that have been cut during the machining. The strands 87 serve to comb the eyelashes, eyebrows and/or capillary fibers, while the cells 84 form the reserves of product.

The length of the strands 87 is comprised between 0.1 mm and 4 mm, preferably between 0.5 mm and 2 mm, it being understood that, particularly because of the random nature of the positioning of the cells within the foam 80, the strands 87 have mutually different lengths.

In the example illustrated, the foam 80 used is a cross-linked polyurethane foam (PUR), the density of the foam 80 is approximately 30 kg/m$^3$, and the number of cells 84 per unit length is approximately 30 PPI.

The invention claimed is:

1. An applicator for applying a product to keratinous materials, comprising:

an application member for applying the product on the keratinous materials, and a trough at least partially surrounding the application member, when the applicator is viewed in cross section, over an angular extent greater than 60°, the trough having a trench shape forming a furrow with a depth that accommodates the application member therein, the application member and the trough being configured in such a way that there is no sliding of the application member with respect to the trough, wherein the application member has an application ridge along the trough for the application and combing of the eyelashes, eyebrows and/or capillary fibers, and all parts of the trough that are positioned on the opposite side from the application member are free of bristles, wherein the formation of the application ridge along the trough is due to a forced orientation, by the trough, of bristles arranged on the application member toward the outside.

2. The applicator as claimed in claim 1, in which the angular extent of the trough, when the applicator is viewed in cross section, is less than 320°.

3. The applicator as claimed in claim 1, in which the trough has an outer surface free of any projecting relief.

4. The applicator as claimed in claim 1, in which the application member is at least partially compressed in the trough.

5. The applicator as claimed in claim 1, in which the trough extends over most of the length of the application member, when the applicator is viewed from the side.

6. The applicator as claimed in claim 1, in which the trough has two longitudinal edges which are in contact with the application member.

7. The applicator as claimed in claim 6, in which the longitudinal edges of the trough place pressure on the application member.

8. The applicator as claimed in claim 1, in which the trough has a snap-fastening tab at its proximal end, in order to allow it to be snap-fastened onto the applicator.

9. The applicator as claimed in claim 1, in which the application member has a brush, notably a brush having a core, which extends along a longitudinal axis, and bristles which are held by the core in a portion of the latter.

10. The applicator as claimed in claim 9, in which the bristles of the brush have free ends defining an envelope surface, the envelope surface having a shape chosen from the following list: cylindrical, non-cylindrical, peanut shape, kidney shape, rugby ball shape, truncated cone shape.

11. The applicator as claimed in claim 1, in which at least one longitudinal edge of the trough is non-rectilinear.

12. The applicator as claimed in claim 1, in which the application member comprises a block of porous material.

13. The applicator as claimed in claim 1, wherein the application ridge is convex or concave.

14. A packaging and application device, comprising:

a container containing a product to be applied, an applicator as claimed in claim 1.

15. A method for making up the eyelashes or eyebrows, in which the application member of the applicator as claimed in claim 1 is used to apply the product to the eyelashes or the eyebrows, by orienting the application member toward the eyelashes or eyebrows and orienting the trough opposite thereto, toward the eyeball.

16. A method for assembling an applicator as claimed in claim 1, in which the application member is inserted into the trough.

17. The method of claim 16, wherein the distal end of the application member is first of all inserted into the trough before inserting the proximal end of the application member into the trough.

18. An applicator for applying a product to keratinous materials, comprising:

an application member for applying the product on the keratinous materials, and a trough at least partially surrounding the application member, when the applicator is viewed in cross section, over an angular extent greater than 120°, the application member and the trough being configured in such a way that there is no sliding of the application member with respect to the trough, wherein the application member has an application ridge along the trough for the application and combing of the eyelashes, eyebrows and/or capillary fibers, all parts of the trough that are positioned on the opposite side from the application member are free of bristles, wherein the formation of the application ridge along the trough is due to a forced orientation, by the trough, of bristles arranged on the application member toward the outside.

* * * * *